US006993893B2

(12) United States Patent
Siddoway

(10) Patent No.: US 6,993,893 B2
(45) Date of Patent: Feb. 7, 2006

(54) CINCH

(76) Inventor: Brett L. Siddoway, 4815 W. 5100 South, Hooper, UT (US) 84315

( * ) Notice: Subject to any disclaimer, the term of this patent is extended or adjusted under 35 U.S.C. 154(b) by 0 days.

(21) Appl. No.: 10/377,236

(22) Filed: Feb. 27, 2003

(65) Prior Publication Data

US 2004/0168414 A1 Sep. 2, 2004

(51) Int. Cl.
*B68V 1/14* (2006.01)

(52) U.S. Cl. ..... 54/23
(58) Field of Classification Search ..... 54/4, 54/23, 35
See application file for complete search history.

(56) References Cited

U.S. PATENT DOCUMENTS 4,434,604 A * 3/1984 Bird ..... 54/23
4,570,424 A * 2/1986 Simpson ..... 54/23
5,566,533 A * 10/1996 Larisch ..... 54/23
5,816,031 A * 10/1998 Marshall ..... 54/23
5,946,892 A * 9/1999 Siddoway ..... 54/23
6,220,003 B1 * 4/2001 Hung ..... 54/23
6,389,784 B1 * 5/2002 Siddoway ..... 54/23

* cited by examiner

*Primary Examiner*—Son T. Nguyen
(74) *Attorney, Agent, or Firm*—Fehr Law Firm; Thompson E. Fehr

(57) ABSTRACT

A Cinch having a fastening strap and an elongated cushion either permanently or releasably attached to one another. The elongated cushion preferably has a resilient edge along at least the front of the body of the elongated cushion and around the ends of the body of the elongated cushion. Optionally, the edge has a discontinuity at each end of the body, and along the front of the body. When the edge is also along the rear of the body of the elongated cushion, the edge also optionally contains a discontinuity along such rear. The fastening strap preferably comprises a unitary belt having one or more fastening devices at each end. The fastening strap and the elongated cushion can either be generally linear or have a triangular shape. The generally linear version of the elongated cushion preferably symmetrical, having a resilient edge on the front, the rear, and around each end.

57 Claims, 5 Drawing Sheets

CINCH

BACKGROUND OF THE INVENTION

1. Field of the Invention

This invention relates to cinches that pass beneath the belly of an animal such as a horse, mule, llama, etc. to secure a riding saddle or pack frame on the animal.

2. Description of the Related Art

Riding saddles for people and pack frames to carry loads have long been secured to animals using cinches that extend from and are releasably connected to the saddle or frame beneath the belly of the animal. Such cinches are, as the name implies, pulled tight after fastening in order to maintain the saddle or frame in place on the animal. Of course, the cinch must be tightened sufficiently that, when a person sits on the saddle or a load is tied to the frame, the saddle or frame will not slip, revolve around the animal's body, and discharge the rider or load as a result of movement by the animal.

Examples of patents which exist in this field are U.S. Pat. Nos. 3,828,521; 4,434,604; 4,426,924; 5,566,533; 5,743,072; 5,768,864; 5,946,892; 6,220,003; and 6,389,784.

U.S. Pat. No. 5,946,892 made a cinch more comfortable for an animal by placing fabric-covered foam layers surrounding a somewhat traditional strap with buckles at each end. The fabric-covered foam layer 12 that is intended to be next to the animal has, according to lines 20 through 29 in column 2, " . . . a grid pattern, with blocks 34 formed between grooves 36 on the outer face (animal engaging face) of the layer 12. The blocks 34 may, for example, have a generally rectangular shape 34*a*, they may be shaped as strips 34*b* or they may be in other patterns that will provide grooves that will carry sweat away from the belly of the animal on which the cinch is used. The grooves 36 extend transversely across the outer face of layer 12 or are connected to other grooves 36 that extend fully across to an outer edge of the face of layer 12." Nothing, though, indicates that the grooves 36 extend to or into the buckle recesses 30 and 32.

Lines 47 through 50 in column 2 of U.S. Pat. No. 5,946,892 further explain that "[t]he cinch 10 is assembled with layer 16 positioned between layers 12 and 14, and the layers are sewn together such that buckle recesses 30 and 32 extend beyond ends 26 and 28 of layer 14 to receive buckles 66 and 68." Lines 30 through 31 in column 2 provide, "Layer 14 comprises an elongate core 37 of the foam material . . . . " And lines 35 through 39 state, "Layer 16 comprises straps 52, 54, 56 and 58, with straps 52 and 54 having spaced apart straps 56 and 58 sandwiched between straps 52 and 54. The edges of the assembled cinch 10, having no grooves 36 in layer 14 tend to be rather inflexible. Combined with the stitching of the layers 12, 14, and 16, this inflexibility can tend to irritate the animal.

No longitudinal grooves of U.S. Pat. No. 5,946,892 are disclosed to reach the portion of layer 16 which is intended to cover the buckles 66 and 68, i.e., buckle recesses 30 and 32.

With respect to U.S. Pat. Nos. 5,946,892, 6,389,784 changed the terminology; utilized fewer layers; and removably, rather than permanently, attached the buckle strap (formerly termed the third elongate layer) to the animal engagement strap (formerly termed the first elongate layer) by having the buckle strap either releasably wrapped with securement flaps that are sewn to the animal engagement strap or slide between the animal engagement strap and a single sheet of material the sides of which are sewn to the animal engagement strap. Furthermore, in U.S. Pat. No. 6,389,784 does not have a grid pattern constructed in the side of the animal engagement strap but merely possesses lands and grooves that are only transversely oriented on such side.

BRIEF SUMMARY OF THE INVENTION

The present invention further increases the level of comfort for the animal and also further facilitates securely tightening the cinch.

A new elongated cushion, which is analogous to the animal engagement strap and the first elongate layer of U.S. Pat. Nos. 6,389,784 and 5,946,892, provides the increased comfort; and a new fastening strap, which is analogous to the buckle strap and the third elongate layer of U.S. Pat. Nos. 6,389,784 and 5,946,892, aids the secure tightening of the cinch.

As with the analogous components of prior patents, the elongated cushion is preferably constructed of a smooth, durable, resilient, non-porous plastic material that will not absorb moisture and even more preferably of a moldable, closed-cell foam. Also, preferably at least the portion or portions of the elongated cushion which are likely to contact the leg of the animal has a, preferably resilient, edge flexibly attached to such portion or portions. And since the portions of the elongated cushion which are most likely to contact the leg of the animal are those portions near each of the forelegs, flexibility will be greatest and irritation minimized if the edge has at least one discontinuity between the ends of the elongated cushion.

Additionally, it is preferable to have one or more longitudinal grooves on a first side of the elongated cushion, i.e., on the side of the elongated cushion that is intended to be placed adjacent to the animal, preferably extending from inside a first fastener rest located near a first end of the elongated cushion into a second fastener rest located near a second end of the elongated cushion. If there are more than two longitudinal grooves, it is immaterial whether such longitudinal grooves are evenly or unevenly spaced.

Preferably, one or more transverse grooves are on the first side of the elongated cushion and preferably intersect one or more of the longitudinal grooves. Again, if there are more than two transverse grooves, it is immaterial whether such transverse grooves are evenly or unevenly spaced.

The longitudinal grooves and the transverse grooves increase the comfort of the animal in several ways. Such grooves facilitate the movement of sweat away from the animal, permit air to circulate between the elongated cushion and the animal, and enable the elongated cushion to bend in order to move better with changes in the animal's body caused by muscular contractions and the like.

The grooves are preferably formed by heat molding, as discussed in U.S. Pat. Nos. 6,389,784 and 5,946,892. Also, preferably, the first side of the elongated cushion is optionally covered with strong four-way stretch fabric which conforms to the surface of the first side of the elongated cushion, although two-way stretch fabric is acceptable. Again, U.S. Pat. Nos. 6,389,784 and 5,946,892 discuss examples of appropriate materials and methods for bonding the fabric to material from which the underlying cushion is created.

The shape and dimensions of the elongated cushion are selected so that the cushion will at least extend longitudinally and transversely at least as far as does the fastening strap.

The fastening strap, itself, has two different embodiments.

In each embodiment a unitary belt is preferably utilized in order to facilitate better tightening by equalizing pressure throughout the strap.

In one embodiment, the belt comprises a mid-section extending substantially the full length of the fastening strap. At each end of the mid-section, the belt is folded and bent so that a first end segment and a second end segment form a triangular pattern with the mid-section.

In the other embodiment, the first end segment and the second end segment of the belt are folded in alignment with the mid-section.

For either embodiment, one or more of any fastening device known in the art, preferably a buckle but also including at least the releasable plastic fasteners commonly associated with back packs wherein a male connector is releasably and lockably inserted into a female connector, is attached to the belt at each end of the mid-section.

The elongated cushion and the fastening strap can either be permanently connected to one another, preferably with an adhesive, or releasably connected to one another, preferably with hook and loop fasteners.

DETAILED DESCRIPTION OF THE INVENTION

Figure 1:
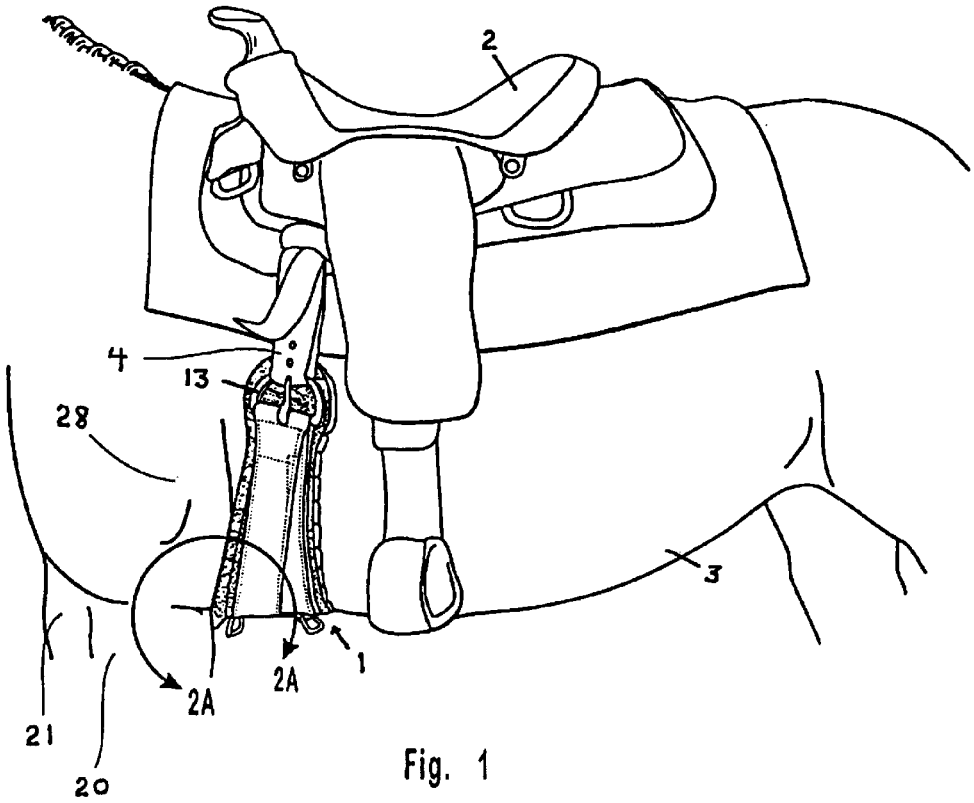
FIG. 1 is a fragmentary view of a saddled horse with the saddle being held in place by a cinch of the present invention.

FIG. 1 illustrates a first preferred embodiment of the Cinch 1 securing a saddle 2 to a horse 3 through the use of straps 4, only one of which is shown in FIG. 1. Another strap 4, not shown, is similarly connected to the saddle 2 on the opposite side of the horse. The Cinch 1 is pulled tightly against the underside of the horse 3, or other animal, by tightening the straps 4.

Figure 5:
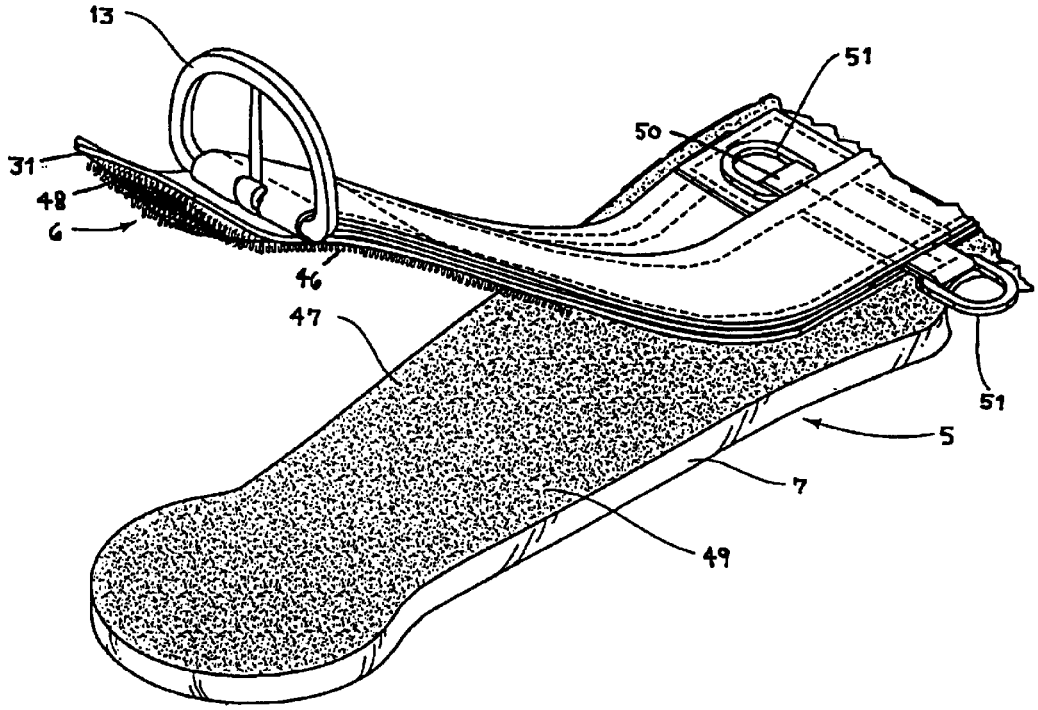
FIG. 5 is a fragmentary perspective view of a first embodiment of the cinch of the present invention, illustrating the separation of the fastening strap from the elongated cushion as well as the manner of assembling such embodiment.
Figure 6:
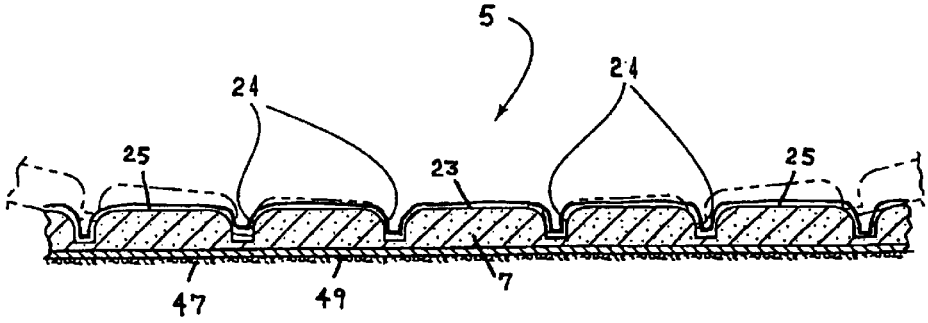
FIG. 6 portrays a vertical section taken on the line 6—6 of FIG. 3.
Figure 7:
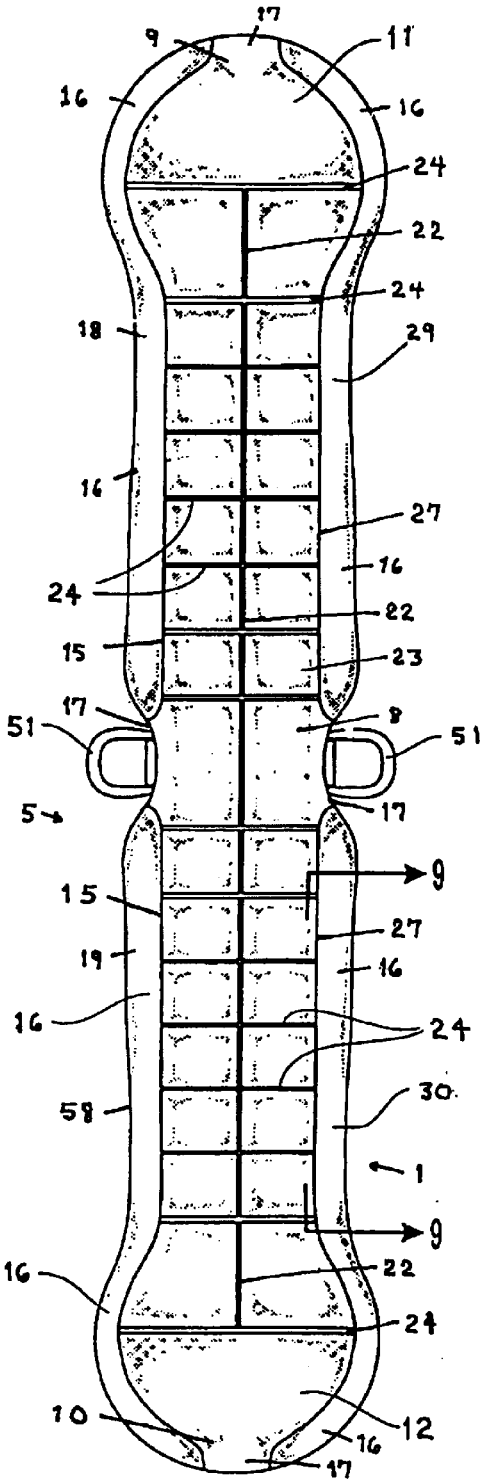
FIG. 7 depicts a top plan view of a second embodiment of the cinch of the present invention.
Figure 8:
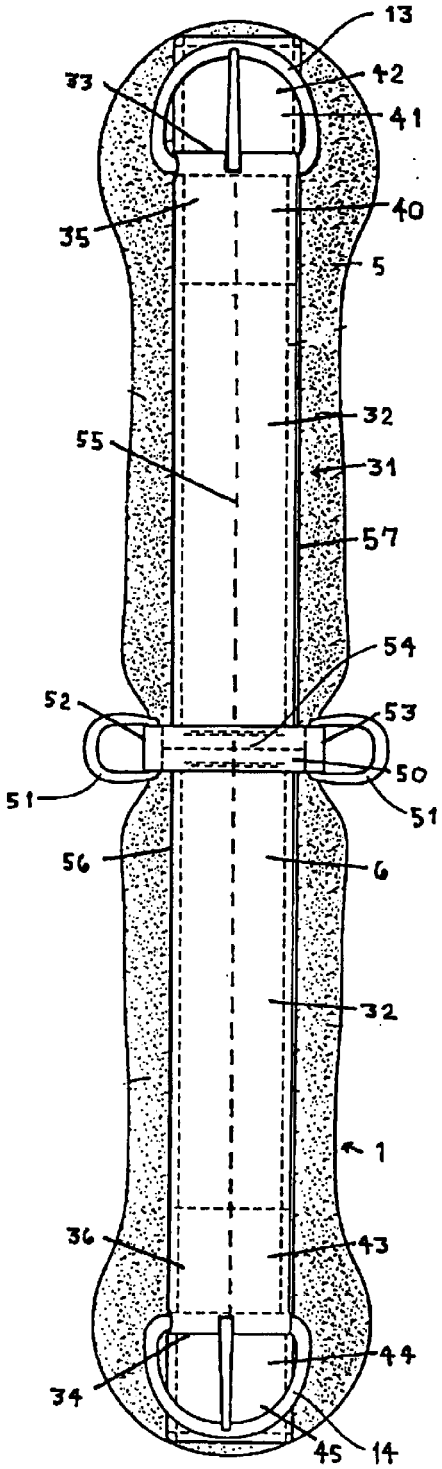
FIG. 8 presents a bottom plan view of the embodiment shown in FIG. 7.
Figure 9:
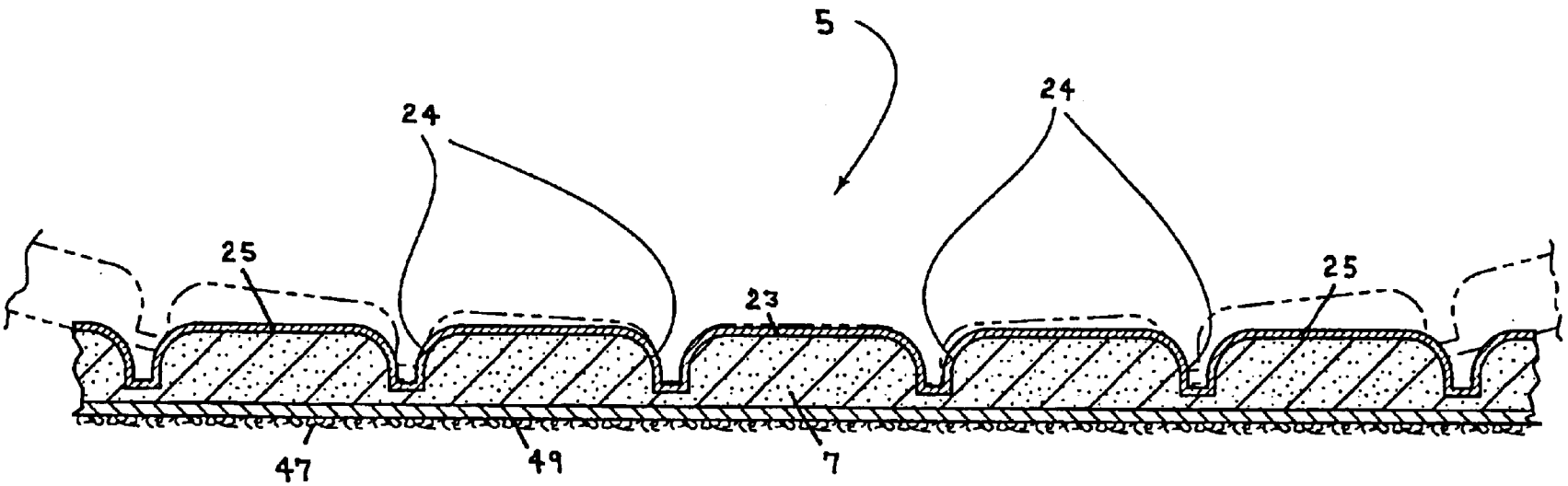
FIG. 9 displays a vertical section taken on the line 9—9 of FIG. 7.

A first embodiment of the Cinch 1 is illustrated in FIG. 3, FIG. 4, FIG. 5, and FIG. 6; a second embodiment, in FIG. 7, FIG. 8, and FIG. 9.

Figure 3:
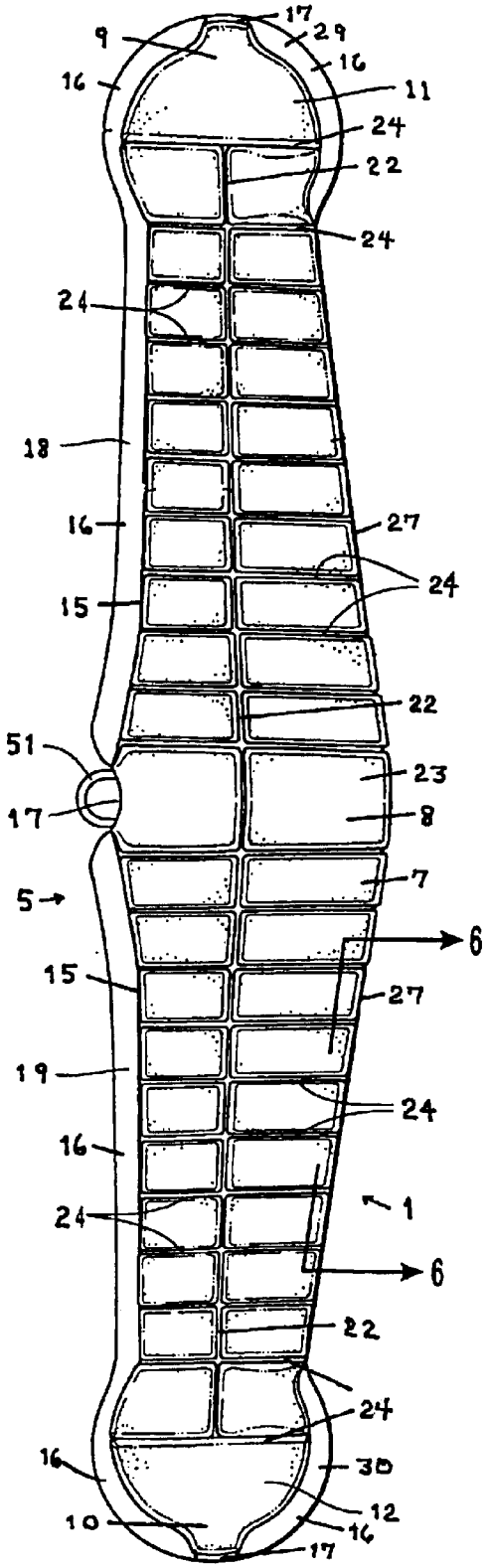
FIG. 3 provides a top plan view of a first embodiment of the cinch of the present invention.
Figure 4:
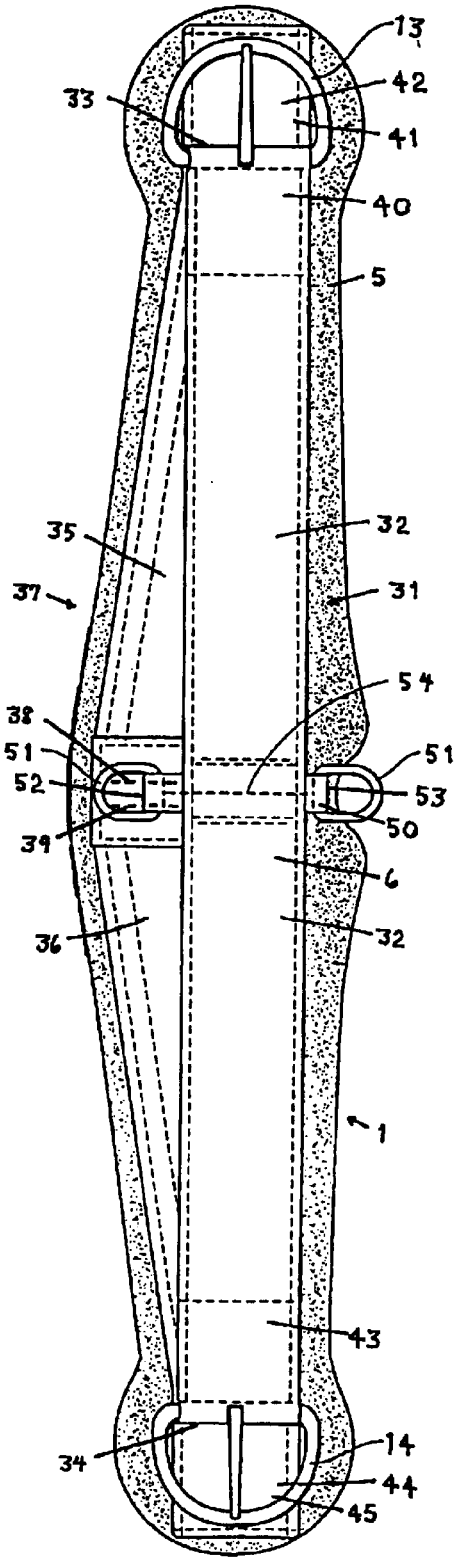
FIG. 4 shows a bottom plan view of a first embodiment of the cinch of the present invention.

As indicated above and depicted in FIG. 3 and FIG. 4, the Cinch comprises an elongated cushion 5 and a fastening strap 6.

Consideration will initially be given to the first embodiment of the elongated cushion 5.

The elongated cushion 5 includes a body 7 having a central portion 8 running between a first end 9 and a second end 10 of the body 7. At the first end 9 is a first fastener rest 11, and at the second end 10 is a second fastener rest 12. The fastener rests 11, 12 protect the animal 3 from the fastening devices 13, 14 that are utilized releasably to connect the Cinch 1 to the straps 4. Preferably, the first end 9 of the body 7 of the elongated cushion 5 and the second end 10 of the body 7 of the elongated cushion 5 are rounded.

Figure 2A:
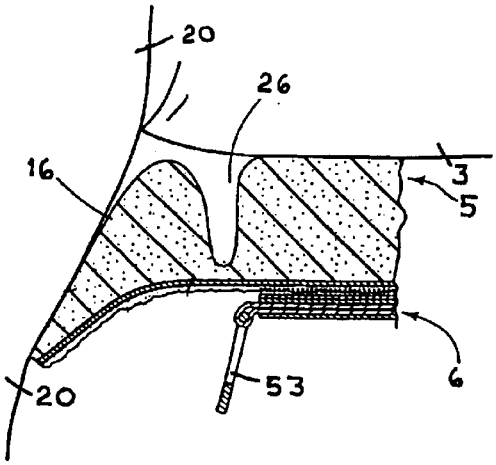
FIG. 2A depicts an enlarged vertical section of the cinch taken within the line 2—2 of FIG. 1 with the fore leg of the horse in a forward position.
Figure 2B:
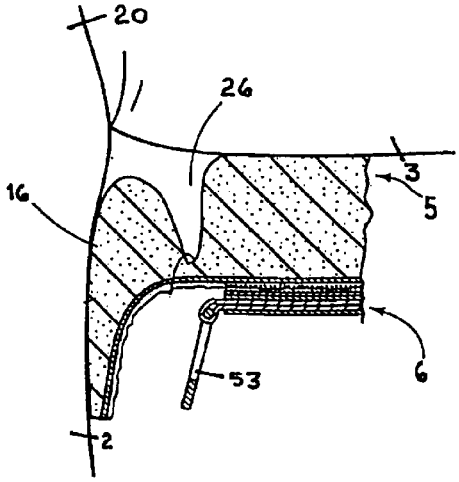
FIG. 2B presents a view differing from that of FIG. 2A only in the fact that the fore leg of the horse is in a rear position.

Preferably, flexibly attached at least to the front 15 of the central portion 8 is an edge 16. The edge 16 is preferably resilient. It can have a cross section which tapers so as to become smaller as the edge 16 proceeds forward, as illustrated in FIG. 2A and FIG. 2B; a rounded cross section; or a cross section that constitutes a polygon. The tapered cross section is, however, preferred.

Also, the edge 16 preferably contains at least one discontinuity 17 between the ends 9, 10 of the body 7 of the elongated cushion 5.

As portrayed in FIG. 3, even with only one discontinuity 17, the edge 16 is divided into two sections 18, 19 which can independently flex or bend and then return to their initial position in response to movement of the animals fore legs 20, 21, as illustrated in FIG. 2A and FIG. 2B for the fore leg 20.

And, preferably, the edge 16 is also flexibly attached around the first end 9 and the second end 10 of the body 7 so that such edge 16 extends around each fastener rest 11, 12, as shown in FIG. 3, in order to protect the animal's shoulder.

Additionally, as stated above, it is preferable to have one or more longitudinal grooves 22 on a first side 23 of the body 7 of the elongated cushion 5, i.e., on the side 23 of the elongated cushion 5 that is intended to be placed adjacent to the animal 3, preferably extending from inside the first fastener rest 11, located at the first end 9 of the body 7 of the elongated cushion 5, into the second fastener rest 12, located at the second end 10 of the body 7 of the elongated cushion 5. Whenever there are more than two longitudinal grooves 22, it is immaterial whether such longitudinal grooves 22 are evenly or unevenly spaced with respect to one another.

Also preferably, one or more transverse grooves 24 are on the first side 23 of the body 7 of the elongated cushion 5 and preferably intersect one or more of the longitudinal grooves 22. Again, if there are more than two transverse grooves 24, it is immaterial whether such transverse grooves 24 are evenly or unevenly spaced with respect to one another.

And again as discussed above, the elongated cushion 5 is preferably constructed of a smooth, durable, resilient, non-porous plastic material that will not absorb moisture and even, more preferably of a moldable, closed-cell foam.

As further noted above, the grooves 22, 24 are preferably formed by heat molding, as discussed in U.S. Pat. Nos. 6,389,784 and 5,946,892. Also, optionally, the first side 23 of the body 7 of the elongated cushion 5 is, as shown in FIG. 6, preferably covered with strong four-way stretch fabric 25 which conforms to the surface of the first side 23 of the elongated cushion 5, although two-way stretch fabric is acceptable. Again, U.S. Pat. Nos. 6,389,784 and 5,946,892 discuss examples of appropriate materials and methods for bonding the fabric 25 to material from which the underlying cushion 5 is created.

Moreover, although the edge 16 is preferably constructed of the same material as the remainder of the elongated cushion 5, it optionally can be constructed of different material. When the material is the same, flexible attachment of the edge 16 to the elongated cushion 5 is, as best illustrated in FIG. 2A and FIG. 2B, accomplished by creating a groove 26 in material which has been shaped to create both the edge 16 and the remainder of the elongated cushion 5 using the heat molding described above.

The second embodiment of the elongated cushion 5 differs from the first embodiment of the elongated cushion 5 primarily by the fact that in the first embodiment of the elongated cushion 5 the edge 16 is, as seen in FIG. 3, preferably flexibly attached at least to the front 15 of the central portion 8 of the body 7 of the elongated cushion 5 and, as also illustrated in FIG. 3, is most preferably not attached to the rear 27 of the central portion 8 of the body 7 of the elongated cushion 5 while, as shown in FIG. 7, the edge 16 in the second embodiment of the elongated cushion 5 is attached to both the front 15 and the rear 27 of the central portion 8 of the body 7 of the elongated cushion 5. This enables the second embodiment of the elongated cushion 5 to be used with either the front 15 or the rear 27 placed toward the front 28 of the animal 3.

In both the first embodiment of the elongated cushion 5 and the second embodiment of the elongated cushion 5 when either embodiment of the elongated cushion 5 incorporates the preferred feature of having the edge 16 also flexibly attached around each fastener rest 11, 12, the edge 16 optionally contains, as portrayed in FIG. 3 and FIG. 7, a discontinuity 17 near the first end 9 of the body 7; a discontinuity 17 near the second end 10 of the body 7; at least one discontinuity 17 between the ends 9, 10 of the body 7 of the elongated cushion 5 along the front 15 of the central portion 8 of the body 7; and, in the case of the second embodiment, at least one discontinuity 17 between the ends 9, 10 of the body 7 of the elongated cushion 5 along the rear 27 of the central portion 8 of the body 7. (As is evident in FIG. 3 and FIG. 7, it is immaterial whether a discontinuity 17 is a notch, as on the front 15 and on the rear 27, or a portion of the body 7 of the elongated cushion 5, as near the first end 9 and near the second end 10.)

Thus, as portrayed in FIG. 3 and FIG. 7, even with only one discontinuity 17 in the edge 16 on the front 15 of the central portion 8 of the body 7 of the elongated cushion 5 and, in the case of the second embodiment, with only one discontinuity 17 on the rear 27 of the central portion 8 of the body 7 of the elongated cushion 5, the edge 16, because of the discontinuity 17 near the first end 9 of the body 7 of the elongated cushion 5 and the discontinuity 17 near the second end 10 of the body 7 of the elongated cushion 5, is divided into four sections 18, 19, 29, and 30 which can independently flex or bend and then return to their initial positions.

As mentioned above, there are two different embodiments for the fastening strap 6.

In each embodiment a unitary belt 31 is, as observed above, preferably utilized in order to facilitate better tightening by equalizing pressure throughout the fastening strap 6.

In the first embodiment of the fastening strap 6, shown in FIG. 4 and FIG. 5, the belt 31 comprises a mid-section 32 extending substantially the full length of the fastening strap 6. At each end 33, 34 of the mid-section 32, the belt 31 is folded and bent so that a first end segment 35 and a second end segment 36 form a triangular pattern 37 with the mid-section 32. The first free end 38 of the belt 31 is also the first free end 38 of the first end segment 35, and the second free end 39 of the belt 31 is also the second free end 39 of the second end segment 36. In the triangular pattern 37, the first free end 38 of the belt 31 and the second free end 39 of the belt 31 are located near one another. (Although folding and bending—and, thus, utilizing a unitary belt 31—is preferable, the first end segment 35 and the second end segment 36 could be separate from the mid-section 32 and simply attached to said mid-section 32 in order to form the triangular pattern 37.)

Preferably, a first end 40 of a first fastener support 41 extends under and is attached to the first end 33 of the mid-section 32 while a second end 42 of the first fastener support 41 extends outward from the first end 33 of the mid-section 32. Similarly, preferably, a first end 43 of a second fastener support 44 extends under and is attached to the second end 34 of the mid-section 32 while a second end 45 of the second fastener support 44 extends outward from the second end 34 of the mid-section 32.

This first embodiment of the fastening strap 6 is attached to the first embodiment of the elongated cushion 5 to create the first embodiment of the Cinch 1. As discussed above, the attachment may be either permanent, preferably accomplished with an adhesive although also being able to be achieved using any permanent connector—such as stitching—that is well known in the art, or releasable, preferably achieved through the use of hook 46 and loop 47 fasteners, such as those known by the trademarked name VELCRO, as illustrated most clearly in FIG. 5 and FIG. 6. Either the hooks 46 are attached to the bottom 48 of the belt 31 of the fastening strap 6 while the loops 47 are connected to the top 49 of the body 7 of the elongated cushion 5, as shown in FIG. 5, or the loops 47 are attached to the bottom 48 of the belt 31 of the fastening strap 6 while the hooks 46 are connected to the top 49 of the body 7 of the elongated cushion 5.

Preferably, a transverse piece 50 having a D-ring 51 at a first end 52 and also at a second end 53 of such transverse piece 50 extends across the mid-section 32 of the belt 31 near the transverse center 54 of such mid-section 32, either above or, as shown in FIG. 4, below the mid-section 32. The transverse piece 50 is preferably constructed of the same type of material as, the belt 31 and is attached to such belt 31.

In the second embodiment of the fastening strap 6, portrayed in FIG. 8, the first end segment 35 and the second end segment 36 of the belt 31 are, preferably folded (although such end segments 35, 36 could be separate and simply connected to the mid-section 32, rather than folded to maintain a unitary belt 31) in alignment with the mid-section 32, making the second embodiment of the fastening strap 6 symmetrical about its longitudinal axis 55 and, therefore, able to have either side 56, 57 toward the front of the animal 3. Otherwise, the first embodiment of the fastening strap 6 and the second embodiment of the fastening strap 6 are the same.

For either embodiment of the fastening strap 6, one or more of any fastening device 13, 14 known in the art, preferably a buckle but also including at least the releasable plastic fasteners commonly associated with back packs wherein a male connector is releasably and lockably inserted into a female connector, is attached to the belt 31 at each end 33, 34 of the mid-section 32, with the first set of such one or more fastening devices 13 being connected to the first end 33 of the mid-section 32 and with the second set of such one or more fastening devices 14 being connected to the second end 34 of the mid-section 32.

The belt 31, again in either embodiment of the fastening strap 6, is made of any suitably strong, flexible, and preferably durable material, such as canvas or reinforced nylon. The nylon may be woven, and there may be several layers sewn together.

As discussed earlier, for either embodiment of the Cinch 1, the shape and dimensions of the elongated cushion 5, or more precisely, of the body 7 of the elongated cushion 5, are selected so that the elongated cushion 5 will extend longitudinally and transversely at least as far as does the fastening strap 6.

And also as mentioned previously, the first embodiment of the Cinch 1 comprises the first embodiment of the elongated cushion 5 and the first embodiment of the fastening strap 6. The triangular pattern 37 of this embodiment creates more surface area to be in contact with the animal 3, which produces more friction to hold the saddle 2 even more securely.

The second embodiment of the Cinch 1 comprises the second embodiment of the elongated cushion 5 and the second embodiment of the fastening strap 6. Since the second embodiment of the elongated cushion 5 can be used with either the front 15 or the rear 27 of such elongated cushion 5 placed toward the front of the animal 3 and since the second embodiment of the fastening strap 6 is able to have either side 56, 57 of such fastening strap 6 toward the front of the animal 3, the entire Cinch 1 of this second embodiment can have either side 58, 59 of such Cinch 1 toward the front of the animal 3, creating the advantage that a user need not be concerned with having a specific side 58, 59 of the second embodiment of the Cinch 1 toward the front of the animal 3.

Furthermore, the second embodiment of the elongated cushion 5 can be either releasably or permanently connected to the second embodiment of the fastening strap 6, using the same technology as explained above with reference to the first embodiment of the Cinch 1.

As used herein the term "preferable" or "preferably" means that a specified element or technique is more acceptable than another but not that such specified element or technique is a necessity.

I claim:

1. A cinch, which comprises:

a fastening strap, which comprises:

a belt having a mid-section with a first end and a second end and also having a bottom;

one or more fastening devices attached to the first end of the mid-section of said belt; and one or more fastening devices attached to the second end of the mid-section of said belt; and an elongated cushion, which comprises:

a resilient body having a central portion running between a first end and a second end of said resilient body, wherein the share and dimensions of said resilient body of said elongated cushion are selected so that said elongated cushion will extend longitudinally and transversely at least as far as does said fastening stray and wherein the top of said resilient body is attached to the bottom of said belt of said fastening strap;

a first fastener rest located at a first end of said resilient body on a first side of said resilient body;

a second fastener rest located at a second end of said resilient body on a first side of said resilient body; and an edge flexibly attached at least to a front of the central portion of said resilient body of said elongated cushion.

2. The cinch as recited in claim 1, wherein:

said edge contains at least one discontinuity.

3. The cinch as recited in claim 2, wherein:

said edge is resilient.

4. The cinch as recited in claim 3, wherein:

said edge has a cross section with a shape selected from the group consisting of tapered, rounded, and polygonal.

5. The cinch as recited in claim 2, wherein:

said edge has a cross section with a shape selected from the group consisting of tapered, rounded, and polygonal.

6. The cinch as recited in claim 1, wherein:

said edge is resilient.

7. The cinch as recited in claim 6, wherein:

said edge has a cross section with a shape selected from the group consisting of tapered, rounded, and polygonal.

8. The cinch as recited in claim 1, wherein:

said edge has a cross section with a shape selected from the group consisting of tapered, rounded, and polygonal.

9. A cinch, which comprises:

a fastening strap, which comprises:

a belt having a mid-section with a first end and a second end and also having a bottom;

one or more fastening devices attached to the first end of the mid-section of said belt; and one or more fastening devices attached to the second end of the mid-section of said belt; and an elongated cushion, which comprises:

a resilient body having a central portion running between a first end and a second end of said resilient body, wherein the shape and dimensions of said resilient body of said elongated cushion are selected so that said elongated cushion will extend longitudinally and transversely at least as far as does said fastening strap and wherein the top of said resilient body is attached to the bottom of said belt of said fastening strap;

a first fastener rest located at a first end of said resilient body on a first side of said resilient body;

a second fastener rest located at a second end of said resilient body on a first side of said resilient body; and an edge flexibly attached to a front of the central portion of said resilient body of said elongated cushion.

10. The cinch as recited in claim 9, wherein:

said edge is also flexibly attached around the first end and around the second end of said resilient body of said elongated cushion.

11. The cinch as recited in claim 10, wherein:

said edge contains at least one discontinuity.

12. The cinch as recited in claim 11, wherein:

said edge is resilient.

13. The cinch as recited in claim 12, wherein:

said edge has a cross section with a shape selected from the group consisting of tapered, rounded, and polygonal.

14. The cinch as recited in claim 11, wherein:

said edge has a cross section with a shape selected from the group consisting of tapered, rounded, and polygonal.

15. The cinch as recited in claim 10, wherein:

said edge is resilient.

16. The cinch as recited in claim 15, wherein:

said edge has a cross section with a shape selected from the group consisting of tapered, rounded, and polygonal.

17. The cinch as recited in claim 10, wherein:

said edge has a cross section with a shape selected from the group consisting of tapered, rounded, and polygonal.

18. The cinch as recited in claim 9, wherein:

said edge contains at least one discontinuity.

19. The cinch as recited in claim 18, wherein:

said edge is resilient.

20. The cinch as recited in claim 19, wherein:

said edge has a cross section with a shape selected from the group consisting of tapered, rounded, and polygonal.

21. The cinch as recited in claim 18, wherein:

said edge has a cross section with a shape selected from the group consisting of tapered, rounded, and polygonal.

22. The cinch as recited in claim 9, wherein:

said edge is resilient.

23. The cinch as recited in claim 22, wherein:

said edge has a cross section with a shape selected from the group consisting of tapered, rounded, and polygonal.

24. The cinch as recited in claim 9, wherein:

said edge has a cross section with a shape selected from the group consisting of tapered, rounded, and polygonal.

25. A cinch, which comprises:

a fastening strap, which comprises:

a belt having a mid-section with a first end and a second end and also having a bottom;

one or more fastening devices attached to the first end of the mid-section of said belt; and one or more fastening devices attached to the second end of the mid-section of said belt;

an elongated cushion, which comprises:

a resilient body having a central portion running between a first end and a second end of said resilient body, wherein the shape and dimensions of said resilient body of said elongated cushion are selected so that said elongated cushion will extend longitudinally and transversely at least as far as does said fastening strap and wherein the top of said resilient body is attached to the bottom of said belt of said fastening strap;

a first fastener rest located at a first end of said resilient body on a first side of said resilient body; and a second fastener rest located at a second end of said resilient body on a first side of said resilient body; and a resilient edge flexibly attached at least to a front of the central portion of said resilient body of said elongated cushion, wherein said resilient edge contains at least one discontinuity and wherein said resilient edge has a cross section with a shape selected from the group consisting of tapered, rounded, and polygonal.

26. A cinch, which comprises:

a fastening strap, which comprises:

a belt having a mid-section with a first end and a second end and also having a bottom;

one or more fastening devices attached to the first end of the mid-section of said belt; and one or more fastening devices attached to the second end of the mid-section of said belt;

an elongated cushion, which comprises:

a resilient body having a central portion running between a first end and a second end of said resilient body, wherein the shape and dimensions of said resilient body of said elongated cushion are selected so that said elongated cushion will extend longitudinally and transversely at least as far as does said fastening strap and wherein the top of said resilient body is attached to the bottom of said belt of said fastening strap;

a first fastener rest located at a first end of said resilient body on a first side of said resilient body; and a second fastener rest located at a second end of said resilient body on a first side of said resilient body; and a resilient edge flexibly attached to a front of the central portion of said resilient body of said elongated cushion and also flexibly attached around the first end and around the second end of said resilient body of said elongated cushion, wherein said resilient edge contains at least one discontinuity and wherein said resilient edge has a cross section with a shape selected from the group consisting of tapered, rounded, and polygonal.

27. A cinch, which comprises:

a fastening strap, which comprises:

a unitary belt having a mid-section with a first end and a second end and also having a bottom;

one or more fastening devices attached to the first end of the mid-section of said belt; and one or more fastening devices attached to the second end of the mid-section of said belt; and an elongated cushion, which comprises:

a resilient body having a central portion running between a first end and a second end of said resilient body, wherein the shape and dimensions of said resilient body of said elongated cushion are selected so that said elongated cushion will extend longitudinally and transversely at least as far as does said fastening strap and wherein the top of said resilient body is attached to the bottom of said belt of said fastening strap;

a first fastener rest located at a first end of said resilient body on a first side of said resilient body; and a second fastener rest located at a second end of said resilient body on a first side of said resilient body an edge flexibly attached at least to a front of the central portion of said resilient body of said elongated cushion.

28. The cinch as recited in claim 27, wherein:

said edge contains at least one discontinuity.

29. The cinch as recited in claim 28, wherein:

said edge is resilient.

30. The cinch as recited in claim 29, wherein:

said edge has a cross section with a shape selected from the group consisting of tapered, rounded, and polygonal.

31. The cinch as recited in claim 28, wherein:

said edge has a cross section with a shape selected from the group consisting of tapered, rounded, and polygonal.

32. The cinch as recited in claim 27, wherein:
said edge is resilient.
33. The cinch as recited in claim 32, wherein:
said edge has a cross section with a shape selected from the group consisting of tapered, rounded, and polygonal.
34. The cinch as recited in claim 27, wherein:
said edge has a cross section with a shape selected from the group consisting of tapered, rounded, and polygonal.
35. The cinch as recited in claim 27, further comprising:
an edge flexibly attached to a front of the central portion of said resilient body of said elongated cushion.
36. The cinch as recited in claim 35, wherein:
said edge is also flexibly attached around the first end and around the second end of said resilient body of said elongated cushion.
37. The cinch as recited in claim 36, wherein:
said edge contains at least one discontinuity.
38. The cinch as recited in claim 37, wherein:
said edge is resilient.
39. The cinch as recited in claim 38, wherein:
said edge has a cross section with a shape selected from the group consisting of tapered, rounded, and polygonal.
40. The cinch as recited in claim 37, wherein:
said edge has a cross section with a shape selected from the group consisting of tapered, rounded, and polygonal.
41. The cinch as recited in claim 36, wherein:
said edge is resilient.
42. The cinch as recited in claim 41, wherein:
said edge has a cross section with a shape selected from the group consisting of tapered, rounded, and polygonal.
43. The cinch as recited in claim 36, wherein:
said edge has a cross section with a shape selected from the group consisting of tapered, rounded, and polygonal.
44. The cinch as recited in claim 35, wherein:
said edge contains at least one discontinuity.
45. The cinch as recited in claim 44, wherein:
said edge is resilient.
46. The cinch as recited in claim 45, wherein:
said edge has a cross section with a shape selected from the group consisting of tapered, rounded, and polygonal.
47. The cinch as recited in claim 44, wherein:
said edge has a cross section with a shape selected from the group consisting of tapered, rounded, and polygonal.
48. The cinch as recited in claim 35, wherein:
said edge is resilient.
49. The cinch as recited in claim 48, wherein:
said edge has a cross section with a shape selected from the group consisting of tapered, rounded, and polygonal.
50. The cinch as recited in claim 35, wherein:
said edge has a cross section with a shape selected from the group consisting of tapered, rounded, and polygonal.
51. The cinch as recited in claim 27, wherein:
said resilient body of said elongated cushion has one or more transverse grooves on a first side of said resilient body.
52. The cinch as recited in claim 51, wherein:
not all adjacent transverse grooves are equidistant from one another.
53. The cinch as recited in claim 27, wherein:
said belt is folded and bent at the first end of the mid-section of said belt of said fastening strap to create a first end segment and also folded and bent at the second end of the mid-section of said belt of said fastening strap to create a second end segment so that the first end segment and the second end segment form a triangular pattern with the mid-section of said belt of said fastening strap.
54. The cinch as recited in claim 27, wherein:
the top of said resilient body of said elongated cushion is releasably attached to the bottom of said belt of said fastening strap.
55. The cinch as recited in claim 27, wherein:
the top of said resilient body of said elongated cushion is permanently attached to the bottom of said belt of said fastening strap.
56. A cinch, which comprises:
a fastening strap, which comprises:
a unitary belt having a mid-section with a first end and a second end and also having a bottom;
one or more fastening devices attached to the first end of the mid-section of said belt; and
one or more fastening devices attached to the second end of the mid-section of said belt;
an elongated cushion, which comprises:
a resilient body having a central portion running between a first end and a second end of said resilient body, wherein the shape and dimensions of said resilient body of said elongated cushion are selected so that said elongated cushion will extend longitudinally and transversely at least as far as does said fastening strap and wherein the top of said resilient body is attached to the bottom of said belt of said fastening strap;
a first fastener rest located at a first end of said resilient body on a first side of said resilient body; and
a second fastener rest located at a second end of said resilient body on a first side of said resilient body; and
a resilient edge flexibly attached at least to a front of the central portion of said resilient body of said elongated cushion, wherein said resilient edge contains at least one discontinuity and wherein said resilient edge has a cross section with a shape selected from the group consisting of tapered, rounded, and polygonal.
57. A cinch, which comprises:
a fastening strap, which comprises:
a unitary belt having a mid-section with a first end and a second end and also having a bottom;
one or more fastening devices attached to the first end of the mid-section of said belt; and
one or more fastening devices attached to the second end of the mid-section of said belt;
an elongated cushion, which comprises:
a resilient body having a central portion running between a first end and a second end of said resilient body, wherein the shape and dimensions of said resilient body of said elongated cushion are selected so that said elongated cushion will extend longitudinally and transversely at least as far as does said fastening strap and wherein the top of said resilient body is attached to the bottom of said belt of said fastening strap;

a first fastener rest located at a first end of said resilient body on a first side of said resilient body; and a second fastener rest located at a second end of said resilient body on a first side of said resilient body; and a resilient edge flexibly attached to a front of the central portion of said resilient body of said elongated cushion and also flexibly attached around the first end and around the second end of said resilient body of said elongated cushion, wherein said resilient edge contains at least one discontinuity and wherein said resilient edge has a cross section with a shape selected from the group consisting of tapered, rounded, and polygonal.

* * * * *